US006262521B1

(12) United States Patent
Lundin et al.

(10) Patent No.: US 6,262,521 B1
(45) Date of Patent: Jul. 17, 2001

(54) DEVICE AND METHOD FOR DETECTION OF PARTICLES

(76) Inventors: Richard Lundin, Skolgatan 33, S-903 25 Umeå (SE); Hans Lauche, Kreuzkirchenstrasse 7, D-377191 Lindau (DE)

( * ) Notice: Subject to any disclaimer, the term of this patent is extended or adjusted under 35 U.S.C. 154(b) by 0 days.

(21) Appl. No.: 09/171,320

(22) PCT Filed: Apr. 16, 1997

(86) PCT No.: PCT/SE97/00643

§ 371 Date: Nov. 13, 1998

§ 102(e) Date: Nov. 13, 1998

(87) PCT Pub. No.: WO97/39473

PCT Pub. Date: Oct. 23, 1997

(30) Foreign Application Priority Data

Apr. 18, 1996 (SE) ..... 9601476

(51) Int. Cl.[7] ..... H01J 43/00

(52) U.S. Cl. ..... 313/103 R; 313/103 CM; 313/105 CM; 313/104

(58) Field of Search ..... 313/103 R, 103 CM, 313/104, 105 R, 105 CM, 532, 534, 528, 533; 250/207

(56) References Cited

U.S. PATENT DOCUMENTS 3,665,497 5/1972 Deradorian et al. .
3,790,840 2/1974 Toyoda .
4,757,229 * 7/1988 Schmidt et al. ..... 313/103 CM

FOREIGN PATENT DOCUMENTS 0 401 879 A2 12/1990 (EP) .

* cited by examiner

*Primary Examiner*—Ashok Patel
*Assistant Examiner*—Karabi Guharay
(74) *Attorney, Agent, or Firm*—Ware, Fressola, Van der Sluys & Adolphson LLP

(57) ABSTRACT

A particle and photon detector includes a body having a beam-incident surface (8) capable of releasing secondary electrons in numbers proportional to the number of particles incident on the surface, and a plurality of secondary electron multiplier channels (4) whose inlet openings are disposed in the beam-incident surface, therewith to amplify the number of secondary electrons. A center channel (2) extends from the beam-incident surface (8) through the detector body and enables a beam of particles or photons to pass through the body. The inlet openings of the secondary electron multipliers are conveniently disposed in the beam-incident surface in a ring around the center channel for receiving secondary electrons. The method applied in the detection of charged particles, such as ions and electrons, in a beam that contains charged and charge-free particles comprises the steps of subjecting the charged particles to the effect of an electric field so as to collect the charged particles in an outer tubular layer or beam which surrounds the residual beam of charge-free particles, such as to form two mutually, coaxial beams, wherein the outer tubular particle beam is captured by a plurality of secondary electron multipliers and wherein signals delivered by the electron multipliers are read-off.

14 Claims, 2 Drawing Sheets

DEVICE AND METHOD FOR DETECTION OF PARTICLES

BACKGROUND OF THE INVENTION

1. Technical Field

The present invention relates to a particle detector for the direct or indirect detection of beam-carried particles, such as ions, electrons, energetically neutral particles and photons. The detector is of the kind that includes a body that has a beam-incident surface which is able to release secondary electrons in numbers proportional to the number of particles incident on said surface, and a secondary electron multiplier channel whose inlet opening is located adjacent the beam-incident surface and functions to amplify the number of secondary electrons. The invention also relates to a method of detecting charged particles, such as ions and electrons, in a beam that contains charged and charge-free particles.

2. Description of the Related Art

Secondary electron multipliers are well-known detectors to those skilled in the art, and are used, for instance, in the detection of ions and other particles, such as electrons and energetically neutral particles. In one application, in addition to containing sought-after ions, a gas beam also includes neutral, charge-free particles that are able to interfere with the detection of ions. It is therefore desirable that solely ions strike the detector.

One known method involves generating an electromagnetic field that causes the charged ion-particles to deviate in a direction that differs from the direction of the original gas beam, therewith forming a separate ion beam. This ion beam is then caused to impinge on a detector. Although some ion losses occur when breaking-up the gas beam, the accuracy of the detection process is markedly improved in relation to a measuring or analyzing process that is carried out directly on the original gas beam.

Channel-type secondary electron multipliers are commercially available. These multipliers include a typical flared or funnel-like inlet opening which is intended to receive a particle-carrying beam for detection, wherewith the particles carried by the beam release secondary electrons in numbers proportional to the number of particles present. Released secondary electrons are attracted into an electron multiplier channel and there trigger an electron avalanche which falls onto an anode or collector at the end of the channel, in which the electron charge that has been torn down is measured. The principles of this type of detection are well known to the person skilled in this art and will not therefore be described in more detail in this document.

EP 0 401 879 A2 teaches a secondary electron multiplier in the form of a monolithic, ceramic body that includes a funnel shaped entry port to an electron multiplier channel. The body is provided internally with a semiconductive secondary electron emitting layer along the channel walls. The channel preferably extends three-dimensionally in a spiral path through the body and exits contiguous to an anode. This device is intended to be used for measuring or analyzing a purely ion beam that contains no disturbing or interfering particles.

Important criteria that separate different types of detectors are sensitivity, accuracy, efficiency and response time.

The response time, i.e. the time between two measuring processes, is dependent on the time taken to recharge the channel layer with electrons subsequent to triggering an electron avalanche.

Sensitivity and accuracy are contingent on detector temperature and the electrical conductivity of the detector, among other things. It is essential to cool the detector effectively, which also lengthens the useful life span of the detector.

Efficiency relates to the relative proportion of incident particles that are detected. The object of the present invention is to provide a detector and a method that are more efficient than present-day detectors and methods.

SUMMARY OF THE INVENTION

The detector of the present invention includes a body having a beam-incident surface which is able to release secondary electrons in numbers proportional to the number of particles incident on said surface, and a secondary electron multiplier channel having an inlet opening located in the beam-incident surface and functioning to amplify the number of secondary electrons, wherein the detector is characterized in that the detector includes a plurality of secondary electron multiplier channels whose respective inlet openings are disposed in one and the same beam-incident surface and take-up secondary electrons emitted therefrom.

The present invention also relates to a method of detecting particles in a beam that includes charged and non-charged particles in gas phase, e.g. downstream of a mass filter, said method comprising the steps of applying an electric field such as to cause the charged particles to collect and form a tubular surface layer around the remaining beam of charge-free particles therewith generating two coaxially layered beams, wherein the tubular outer layer of charged particles can be captured by at least one secondary electron multiplier and/or the charge-free particles in the residual beam can be captured by another secondary electron multiplier, and wherein signals can be read from the electron multipliers. The tubular outer layer of charged particles may conveniently be spaced from the residual, center beam of neutral particles. This enables the inlet openings of a plurality of electron multipliers to be disposed in a ring around the center beam, or core beam, therewith providing a detector of greatly improved efficiency with respect to known detectors. These electron multiplier channels may have a common, first beam-incident surface from which the first array of secondary electrons are released.

The signal from each individual electron multiplier can be read separately, thereby providing a multi-channel analysis facility.

According to the invention, the detector, e.g. for detecting a beam of charged particles and neutral particles in gas phase, may include a) means for generating an electric field which acts on the charged particles and changes their direction of movement in relation to the direction of movement of the neutral or charge-free particles, b) a secondary electron multiplier that includes a particle-incident means that functions to release secondary electrons in numbers proportional to the number of incident particles, and means for amplifying the number of secondary electrons. The detector is characterized in that the means for generating the electric field acting on the charged particles includes a charge which is opposite to the charge of the charged particles and is disposed in a ring, e.g. around the gas beam, such as to attract the charged particles and therewith form a particle beam of hollow cross-section, e.g. externally of a central core beam of charge-free particles, and in that a plurality of secondary electron multipliers are provided for receiving the hollow beam.

The detector may also include a beam-incident surface that is comprised solely of a ring segment or a linear surface having a plurality of inputs to secondary electron multiplier channels extending through the body.

For the sake of simplicity, and by way of example only, the following description will be made solely with reference to charged particles in the form of ions, although it will be understood that the invention is not restricted to ion detection.

The respective input openings of the secondary electron multipliers may be disposed in a ring, for instance around the central core of charge-free particles, for receiving the hollow ion beam. The input openings may be disposed in one plane or mutually displaced in different planes along the beam. They may also be disposed in some other way, for instance with incident planes or dynodes extending into the tubular beam, said ions impinging on the incident planes and releasing the secondary electrons which are then guided into electron multipliers.

The detector may have a generally basin-shaped or funnel-shaped surface, and an opening may be provided in the bottom of the basin shape. The funnel-shaped or basin-shaped surface may be coated with a semi-conductor layer that will function to emit secondary electrons in response to particle impingement, and may include a plurality of secondary electron multipliers whose inlet openings are disposed around the opening in the bottom of said basin surface.

The detector may also include a generally rotationally-symmetrical body that has at its first end a generally funnel-shaped or basin-shaped recess, a channel that extends along the center line of the body, and a plurality of electron multiplier channels which each extend into the body from an opening in the basin-shaped surface.

Naturally, the body may have forms other than rotationally symmetrical forms, e.g. cubic forms, polygonal forms or some other asymmetric form.

The inlet opening, or input port, of the center channel may project out from the bottom of the flared recess, and enlarged inlets to the electron multiplier channels may be disposed in the surface around the center channel at the bottom of the flared recess, so as to form an essentially coherent ring-shaped inlet to the electron multiplier channels.

The electron multiplier channels may extend helically around the center channel, from one end of the body to the other end thereof. In one alternative embodiment, the electron multiplier channels may alternatively arch out from the center channel or may extend linearly or, preferably, non-linearly in the body.

The body may be comprised of a ceramic material and will initially comprise two sections, which are then joined together, e.g. sintered. The body may, alternatively, be made from some other material suitable for the purpose intended and capable of withstanding high temperatures.

Similar to the secondary electron multiplier channels, the flared beam-incident surface may be coated with a coherent, active semiconductor layer in which there is generated a potential difference from the outer edge of the flared beam-incident surface to respective anodes or some other voltage generating means at the end of each electron multiplier channel. This variation in potential contributes to guiding the secondary electrons down into and through the channels up to the anodes.

An electric conductor may be disposed around the first end of the body so as to attract charged particles. In one particular embodiment, the electrical conductor may be disposed along the edge of the recess and caused to apply a potential at the first end of said body, this potential being applied to the semiconductive layer. The arrangement of the conductor around the front edge of the recess and in conductive contact with the semiconductor layer provides a uniform potential around the outer surface of the beam incident surface.

BRIEF DESCRIPTION OF THE DRAWINGS

The invention will now be described in more detail with reference to preferred exemplifying embodiments thereof, and also with reference to the accompanying drawings. To facilitate an understanding of the description, the text includes reference signs which relate to the drawings and which identify similar and equivalent components. In the drawings.

DETAILED DESCRIPTION OF THE INVENTION

Figure 1:
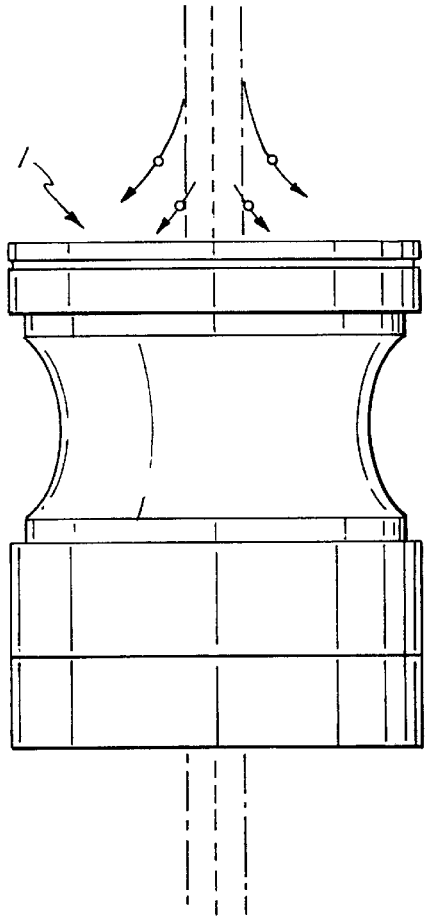
FIG. 1 is a side view of one embodiment of an inventive detector.
Figure 3:
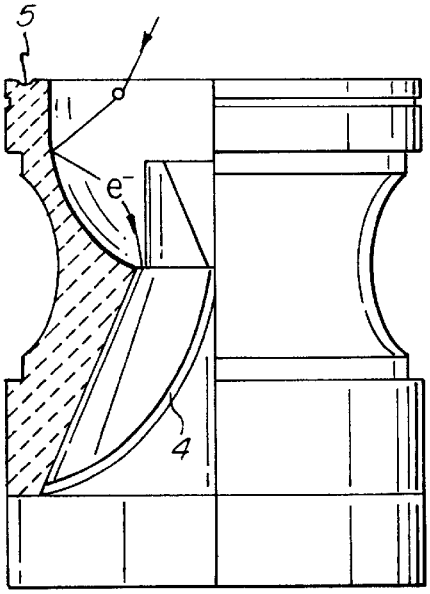
FIG. 3 is a partial cross-sectional view of the detector of FIG. 1 taken along the III—III line of FIG. 2.
Figure 2:
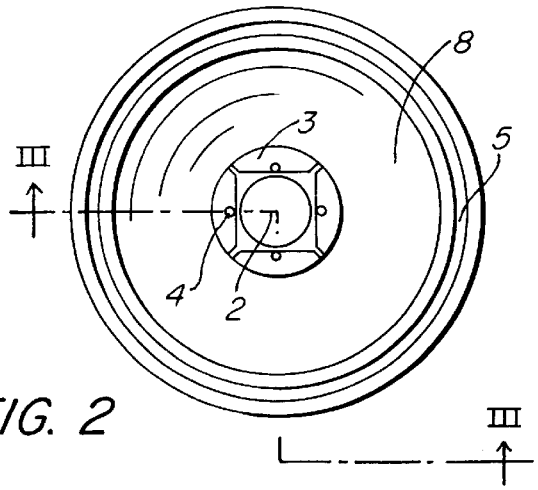
FIG. 2 is a front view of the detector of FIG. 1.
Figure 4:
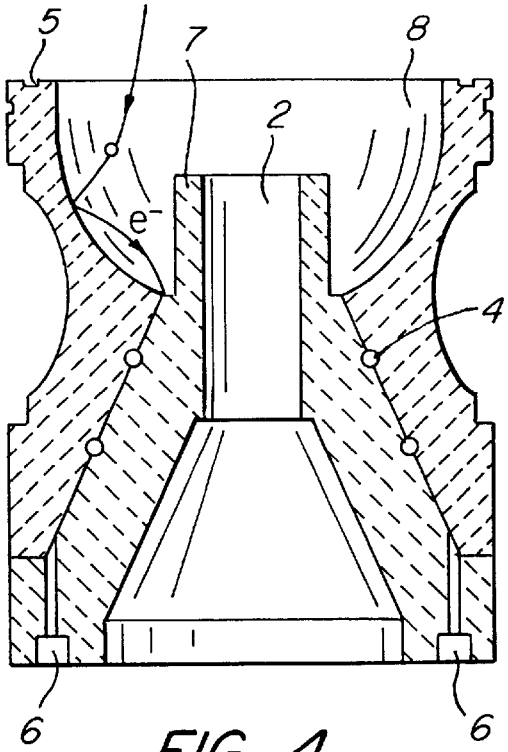
FIG. 4 is a cross-sectional view of the detector shown in FIG. 1.
Figure 5:
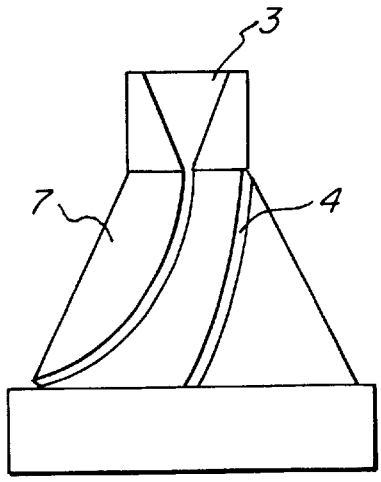
FIG. 5 is a side view of a body blank that forms part of the ultimate detector body.

FIGS. 1–4 illustrate an embodiment of a device which is intended, for instance, for use in the detection of ions in a gas beam that includes ions and neutral, charge-free particles. The detector includes a rotationally symmetrical body 1 which is made of ceramic material and includes a channel 2 that extends through the body along its symmetry axis. The body is intended to be placed over a gas beam of the aforesaid nature, wherein the unaffected gas beam is able to pass freely through the body center channel 2.

In the illustrated embodiment, that side of the body which faces towards the gas beam, i.e. the front side, has a concave, basin-like shape. Disposed in a ring around the center channel on the bottom of the basin are openings 3 which input to four narrower channels 4 that extend through the body helically around the center channel 2 and terminate at its rear end, the rear side. These narrower channels 4 are secondary electron multiplier channels which function to increase the number of secondary electrons in a known manner.

The inner surfaces of the body 1 are coated with a semiconductor layer, e.g. an electrically semiconductive glass layer, from the outer edge of the front side of the basin to the ends of the multiplier channels 4 at the rear end of the body 1, in a known manner. This enables a continuous voltage change to be applied between the front and the rear ends of the body 1.

A uniform potential is obtained around the front edge of the basin with the aid of a metal ring conductor 5, preferably made of platinum.

In one embodiment, the detector is intended to detect positively charged ions in a gas beam from a mass filter. The detector body is arranged so that the gas beam is able to pass through the center channel 2. A potential of about −2 kV is applied to the ring 5, and therewith to the basin-shaped outer surface, whereas a positive potential of about +0.5 kV is applied to the opposite ends of the multiplier channels 4 at the rear end of the body 1, for instance via anodes 6. This generates at the basin-shaped end of the body 1 a potential which attracts positive ions in all directions from the gas beam. The basin-shaped, beam-incident surface 8 then emits secondary electrons in numbers proportional to the number of incident ions, these secondary electrons being attracted in turn by the successively rising positive potential in the secondary electron multiplier channels 4.

The unaffected neutral, or charge-free, particles continue to travel through the body center channel 2.

The body 1 will conveniently include a waisted section and the internal center channel 2 will preferably be flared towards the outlet at the rear end of the body 1. The waisted section of the body 1 facilitates cooling of the body 1 when the incident particle beams have high temperatures. Flaring of the center channel 2 is intended to reduce the build-up of heat in the body 1 as a result of particle collisions with the wall of the center channel.

The center channel inlet may conveniently be located forwardly of the basin-shaped, beam-incident surface 8. This reduces the risk of disturbances from the neutral or charge-free particles, because they are therewith further distanced from the inlets to the secondary electron multiplier channels 4. This is achieved in the illustrated case by extending the center channel forwardly with a tubular projection 7 that projects out through a distance corresponding to one-third of the depth of the basin.

In the illustrated embodiment, the body 1 is made in one piece from a ceramic, sintered material and, in operation, forms a monolithic body.

In the illustrated embodiment, the secondary electron multiplier channels extend spirally around the center channel, wherein the spiral curve increases in circumference with the distance from the inlet.

The body 1 may, of course, be given other external and internal shapes and forms, so as to adapt the body to the application in question and to peripheral equipment.

In one embodiment of the invention, the secondary electron multiplier channels 4 terminate short of the rear end of the body and an anode accommodating recess is provided in the rear end of said body 1.

Although the body 1 has been described with reference to the detection of positive ions, it will be understood that the body 1 can be used alternatively to detect other particles. For instance, negative ions or electrons can be detected by applying a positive potential of about +0.5 kV at the basin-shaped part of the detector, and by applying a potential of about +3 kV at the ends of respective secondary electron multiplier channels 4.

The described detector body 1 may alternatively be used to detect photons and energetic neutral particles. The detector body 1 may conveniently be turned back-to-front, i.e. positionally reversed, in both of these cases, such that, for instance, the photon beam will fall on the rear side of the body through the center channel 2 and impinge on a photo-cathode or the like disposed forwardly of the basin-shaped, beam-incident surface 8. The photo-cathode emits electrons in proportion to the incident photons. These electrons can be detected by applying a potential of about ±0.2 kV at the basin-shaped part of the body 1 and a potential of +2.7 kV at the ends of respective secondary electron channels 4.

Energetic neutral particles can be detected in a similar manner, by placing a conversion plate in front of the basin-shaped incident surface 8 and applying the potentials of ±0.2 kV at the front part of the body 1 and a potential of +3 kV at the ends of respective secondary electron channels 4. Whether or not a positive or negative potential is applied at the incident surface 8 will depend on whether it is electrons or sputtering-ions that are to be attracted towards the incident surface 8 subsequent to being emitted from the conversion plate.

In a further embodiment of the invention, two detectors can be used together in a mirror-inverted tandem configuration for simultaneously measuring electrically charged and neutral particles in a gas beam. This embodiment is useful when monitoring and trimming the degree of ionization in a gas beam. Such measurements are achievable by placing a detector for measuring electrically charged ? particles in front of a detector for measuring energetic neutral particles. The rearward detector therewith measures particles that have been released through the center hole of the front detector, in the aforedescribed manner. The two mirror-inverted detectors may also be arranged in one and the same body with one and the same center hole, e.g. in a sintered monolithic body, wherewith the front detector utilizes the front part of the body and the rear detector is accommodated in the rear part of said body.

In a further embodiment of the invention, the detector body includes a beam-incident surface which has a shape that corresponds solely to a part of said circular shape. Thus, a number of such parts can be disposed in a circle if so desired. The detector body may alternatively be provided with a straight or slightly curved beam-incident surface which is common to the inlet openings.

What is claimed is:

1. A particle detector comprising a detector body that includes a generally basin-shaped beam-incident surface capable of releasing secondary electrons in proportion to particles incident thereon, a through-flow opening of a through-flow channel is disposed in a bottom of the beam-incident surface and a plurality of secondary electron multiplier channels having respective inlet openings disposed in the beam-incident surface around the through-flow opening for receiving secondary electrons and amplifying the number of secondary electrons.

2. A detector according to claim 1, wherein the beam-incident surface is coated with a first semiconductive layer capable of releasing secondary electrons in response to impingement of particles thereon and the electron multiplier channels are coated with a second semiconductive layer which is coherent with the first semiconductive layer and capable of releasing an avalanche of secondary electrons.

3. A detector according to claim 2, wherein the detector body is a rotationally symmetrical body that includes a generally basin-shaped recess at a first end and forming the beam-incident surface, the through-flow channel is disposed along a center line of the body, and each of the electron multiplier channels extends from the beam-incident surface into the body.

4. A detector according to claim 3, wherein the through-flow opening of the through-flow channel projects out from the beam-incident surface and at least one enlarged inlet to the electron multiplier channels is disposed in the beam-incident surface around the through-flow channel.

5. A detector according to claim 4, wherein the electron multiplier channels extend spirally around the through-flow channel from one end of the body to another end where the through-flow channel has another opening, the through-flow channel having a cross-sectional area which widens towards the other opening.

6. A detector according to claim 5, wherein the body is comprised of a ceramic one-piece structure.

7. A detector according to claim 6, wherein the first semiconductive layer on beam-incident surface and the second semiconductive layer on the electron multiplier channels form a coherent semiconductive layer for generating a continuous potential difference from the beam incident surface to respective anodes disposed at ends of the electron multiplier channels, whereby a charged particle is attracted to the beam-incident surface and therewith releases secondary electrons that are attracted into the electron multiplier channels and pass therethrough to the respective anodes, and an electric conductor disposed around the first end of the body along an edge of the recess so as to obtain a uniform electric potential around a circumference of the beam-incident surface.

8. A detector according to claim 1, wherein the detector body is a rotationally symmetrical body that includes a generally basin-shaped recess at a first end and forming the beam-incident surface, the through-flow channel disposed along a center line of the body, and each of the electron multiplier channels extend from the beam-incident surface into the body.

9. A detector according to claim 8, wherein the beam-incident surface and the electron multiplier channels are coated with a coherent semiconductive layer for generating a continuous potential difference from the beam incident surface to respective anodes disposed at ends of the electron multiplier channels, whereby a charged particle is attracted to the beam-incident surface and therewith releases secondary electrons that are attracted into the electron multiplier channels and pass therethrough to the respective anodes, and an electric conductor disposed around the first end of the body along an edge of the recess so as to obtain a uniform electric potential around a circumference of the beam-incident surface.

10. A detector according to claim 1, wherein the through-flow opening of the through-flow channel projects out from the beam-incident surface and at least one enlarged inlet to the electron multiplier channels is disposed in the beam-incident surface around the through-flow channel.

11. A detector according to claim 1, wherein the body is comprised of a ceramic one-piece structure.

12. A particle detector comprising a detector body that includes a generally basin-shaped beam-incident surface capable of releasing secondary electrons in proportion to particles incident thereon, a through-flow opening of a through-flow channel is disposed in a bottom of the beam-incident surface and a plurality of secondary electron multiplier channels having respective inlet openings disposed in the beam-incident surface around the through-flow opening for receiving secondary electrons and amplifying the number of secondary electrons, wherein the electron multiplier channels extend spirally around the through-flow channel from one end of the body to another end where the through-flow channel has another opening, the through-flow channel having a cross-sectional area which widens towards the other opening.

13. A method of detecting charged particles, such as ions and electrons, in a beam that contains charged and charge-free particles, comprising the steps of:

(a) subjecting the charged particles to an electric field such as to collect the charged particles in a tubular outer particle beam which surrounds a residual beam of charge-free particles and therewith form two mutually, axial beams;

(b) capturing the outer tubular particle beam in a plurality of secondary electron multipliers; and (c) reading signals delivered from the electron multipliers.

14. A method according to claim 13, wherein inlet orifices of electron multipliers are arranged in a ring around the residual beam of charge-free particles.

* * * * *

UNITED STATES PATENT AND TRADEMARK OFFICE

CERTIFICATE OF CORRECTION

PATENT NO. : 6,262,521 B1
DATED : July 17, 2001
INVENTOR(S) : Richard Lundin and Hans Lauche It is certified that error appears in the above-identified patent and that said Letters Patent is hereby corrected as shown below:

Column 5,
Line 30, after "channels", -- 4 -- should be inserted.
Line 57, "± 0.2" should be -- + 0.2 --.

Signed and Sealed this

First Day of January, 2002

*Attest:*

*Attesting Officer*

JAMES E. ROGAN
*Director of the United States Patent and Trademark Office*